US007354132B2

(12) United States Patent
Suzuki

(10) Patent No.: US 7,354,132 B2
(45) Date of Patent: Apr. 8, 2008

(54) LIQUID EJECTING APPARATUS

(75) Inventor: Kazunaga Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 608 days.

(21) Appl. No.: 10/635,850

(22) Filed: Aug. 7, 2003

(65) Prior Publication Data

US 2005/0073548 A1 Apr. 7, 2005

(30) Foreign Application Priority Data

Aug. 7, 2002 (JP) ..... P.2002-230289

(51) Int. Cl.
*B41J 2/165* (2006.01)

(52) U.S. Cl. ..... 347/23; 347/29; 347/30

(58) Field of Classification Search ..... 347/23, 347/20, 35, 29, 30, 22
See application file for complete search history.

(56) References Cited

U.S. PATENT DOCUMENTS 4,926,196 A * 5/1990 Mizoguchi et al. ..... 347/23
6,616,264 B2 * 9/2003 Mitsuzawa et al. ..... 347/23
6,846,062 B2 * 1/2005 Harada et al. ..... 347/30

FOREIGN PATENT DOCUMENTS

| | | |
|---|---|---|
| JP | 2000-238295 | 9/2000 |
| JP | 3209419 | 7/2001 |
| JP | 2001-293860 | 10/2001 |

* cited by examiner

*Primary Examiner*—Manish S. Shah
(74) *Attorney, Agent, or Firm*—Sughrue Mion, PLLC

(57) ABSTRACT

A liquid ejecting apparatus includes a liquid ejecting head, having nozzle orifices for ejecting liquid therefrom and a controller which performs a recovery operation for removing liquid having a changed liquid property, the liquid being on the nozzle orifices and the vicinities thereof. The recovery operation is performed by using at least a flushing operation in which the liquid drops are ejected from the nozzle orifices and a cleaning operation in which a negative pressure is applied to the nozzle orifices. An operation condition of the cleaning operation is set in accordance with an operation history of the flushing operation performed before the cleaning operation.

7 Claims, 9 Drawing Sheets

| NUMBER OF FLUSHING TIMES | CLEANING MODE |
|---|---|
| 1-10 | CL3 |
| 11-100 | CL2 |
| 101- | CL1 |

| NONOPERATING TIME | CLEANING MODE |
|---|---|
| -10HR | CL1 |
| 10-100HR | CL2 |
| 100HR- | CL3 |

| LAST PERFORMED FLUSHING MODE | -10HR | 10-100HR | 100HR- |
|---|---|---|---|
| FL1 | CL1 | CL2 | CL3 |
| FL2 | CL2 | CL3 | CL4 |
| FL3 | CL3 | CL4 | CL5 |
| FL4 | CL4 | CL5 | CL6 |

LIQUID EJECTING APPARATUS

BACKGROUND OF THE INVENTION

This invention relates to a liquid ejecting apparatus for ejecting liquid pressurized in pressure generating chambers in the form of liquid drops through nozzle orifices.

There is known a liquid ejecting device of the type which ejects a liquid pressurized in a pressure generating chamber in the form of liquid drops through nozzle orifices, and the liquid ejecting apparatus is capable of ejecting any of various kinds of liquids. A typical example of such a liquid ejecting device is a recording head used in an ink jet recording apparatus. A related technique will be discussed with reference to FIGS. 8 and 9 by taking a record head of an ink jet record apparatus as an example.

The recording head includes a flow passage unit 1 having nozzle orifices 2 and a head case 9 in which the flow passage unit 1 is attached thereto by bonding.

The flow passage unit 1 is formed with a nozzle plate 3, a passage substrate 5 and a vibration plate 6, which are laminated into a unit form. The nozzle plate 3 has a nozzle forming surface 3A in which an array of nozzle orifices 2 are formed. The passage substrate 5 includes an array of pressure generating chambers 4 formed therein which respectively communicate with the nozzle orifices. The vibration plate 6 closes the openings of lower parts of the pressure generating chambers 4. Ink reservoirs 8 are formed in the passage substrate 5. Each ink reservoir 8 communicates with the pressure generating chamber 4 associated therewith via an ink passage 7, and reserves ink to be fed to the pressure generating chamber 4. The whole recording head is denoted as H.

The head case 9, which forms a base member of the recording head H, is formed by injection molding using thermosetting resin or thermoplastic resin. A pressure generating element 11 is placed in a space 10 which vertically extends in the structure. A back end of the pressure generating element 11 is fixed to a fixing plate 12 mounted on the head case 9, and a fore end of the same is fixed to a island 6A on the lower surface of the vibration plate 6.

A pressure generating chamber 4, a pressure generating element 11, and a nozzle orifice 2 are vertically arranged in the structure. A number of combinations each consisting of them are arrayed in a direction perpendicular to a surface of the drawing. In this instance, two linear arrays of nozzle orifices are formed. Those nozzle linear arrays eject ink such that the same kind of ink is ejected for each nozzle linear array.

Conducting wires for input 13 are connected to the pressure generating elements 11, respectively. The conducting wires are inserted into and passed through through-holes 14A of a head substrate 14, and then connected to printed wirings 15 on the head substrate 14. The printed wirings 15 are gathered and connected to a flexible flat cable 17 via a connector 16. The flexible flat cable 17 is connected to a drive circuit (not shown). When a drive signal is input from the drive circuit to the pressure generating element 11, the pressure generating element 11 is expanded and contracted in the longitudinal direction to vary a pressure within the pressure generating chamber 4. Then, the ink within the pressure generating chamber 4 is ejected through the nozzle orifices 2 in the form of ink drops.

A damper recess 18 is formed at a part of the head case 9 corresponding to each ink reservoir 8. When ink is ejected, the damper recess damps a pressure variation in the ink reservoir 8 with the aid of the vibration plate 6 formed with a polyphenylene sulfide film (referred to as a PPS film). The damper recess 18 is a space isolated from exterior. Air in the damper recess 18 flows out into the ink so as to permeate through the vibration plate 6 formed with the PPS film. An air pressure in the damper recess 18 decreases, and a tension of the vibration plate 6 becomes high. As a result, an unsatisfactory damping effect is frequently obtained. To cope with this, a communication passage 19, which enables the damper recess 18 to communicate with the air, is provided extending from the bottom surface of the damper recess 18 to the opposite surface of the head case 9, to thereby prevent the pressure reduction within the damper recess 18.

In the above structure, an opening area of the damper recess 18 is large, and hence, an area of the vibration plate 6, which covers the opening area, is also large. In particular, when the ink jet recording apparatus is put in a nonuse state, the water content of the ink evaporates and permeates through the vibration plate 6 having the large opening area, and flows into the damper recess 18. With its pressure increase, the vapor passes through the communication passage 19 and scatters into the air. In such a phenomenon, the amount of water in the ink decreases and a viscosity of ink increases. As a result, when the ink jet recording apparatus is operated again, the ink drop ejection is improper. To avoid this, a passage resistance of the communication passage 19 is increased to thereby prevent the excessive vaporation of the water content of the ink.

The ink jet recording apparatus designed for the color printing uses plural kinds of color inks of yellow, magenta, cyan and the like, in addition to black ink. Further, nozzle orifices 2 are provided which are respectively assigned for those colors.

When the print data terminates and the recording head H is put in a non-use state, ink presented at a vicinity of the nozzle orifices 2 is dried, so that the nozzle orifices will be clogged with the dried ink. For this reason, in the related technique, the recording head H is sealed with the cap 38 when no printing operation is performed. The cap 38 is coupled to a suction pump 39 for performing a cleaning operation described below. When the recording head is left in a sealed state for a long time, a solvent of the ink presented at the vicinity of the nozzle orifices 2 gradually evaporates and a viscosity of the ink increases. In a state that the viscosity of the ink is increased, some troubles tend to occur. For example, the printing operation cannot start quickly or a print quality is deteriorated. The nozzle orifices 2, which continuously ejects ink drops in the printing operation, successively receive new ink, and little suffers from the clogging. In the case of the nozzle orifices 2, which are located, for example, at the upper and lower ends of the nozzle array, and have each an extremely small chance of ejecting ink drops, the ink located near those nozzle orifices 2 dries during the printing operation and its viscosity increases, and the recording head is likely to be clogged with the dried ink.

To cope with such a problem, a "flushing operation" or "cleaning operation" is performed for one form of a preparatory operation before the printing operation starts. In the preparatory operation, at a time point that power to the recording apparatus is turned on or that a print signal is first input to the recording apparatus, the nozzle orifices 2 are forcibly caused to eject ink drops independently of the printing, whereby the clogging is removed and the ink ejection ability of the recording head is recovered.

The "flushing operation" removes the ink having an increased viscosity presented at the vicinity of the nozzle orifices 2 in a manner that a drive signal is applied to the pressure generating element 11 independently of print data, and the recording head is caused to eject ink drops of such an ink. The "cleaning operation" is performed when the clogging of the nozzle orifices 2 is not removed completely by only "the flushing operation. In the "cleaning operation", a negative pressure is applied to the nozzle orifices 2 by use of a suction pump thereby to forcibly suck the ink of the increased viscosity in the pressure generating chambers 4 and others.

The viscosity of the ink presented at the vicinity of the nozzle orifices 2 is more increased and the clogging of the nozzle orifices 2 is more deteriorated as a time (cap leaving time) that the recording head H is left as it is sealed with the cap and a total printing time till the recording head is sealed with the cap are longer. Which of the "flushing operation" and the "cleaning operation" is to be performed is determined by a relation (correlation) between the cap leaving time and the total printing time as shown in FIG. 9. When the cap leaving time or the total printing time is short (in a flushing area indicated by FL1 to FL4 ), the flushing operations are performed. When the cap leaving time or the total printing time is long (in the cleaning area), the cleaning operation is performed.

As shown in FIG. 9, the flushing area that is determined by a relation (correlation) between the cap leaving time and the total printing time, is defined into four areas (FL1 to FL4 in this instance) depending on a level of viscosity increase of the ink at and near the nozzle orifices 2. In the area FL1, a degree of the viscosity increase of the ink at and near the nozzle orifices 2 is the lowest. In this degree, to recover the ink ejection ability of the nozzle orifices 2, the black ink (BK) is ejected by 100 shots, and the color ink (COL) is ejected by a small number of shots, 50 shots.

When the cap leaving time or the printing time is somewhat longer than that in the flushing area FL1, the increase degree of the ink at and near the nozzle orifices 2 somewhat increases from that in the flushing area FL1. Therefore, the recovering operation is performed in a flushing area FL2. To recover the ink ejection ability of the nozzle orifices 2, the black ink BK is ejected by 1000 shots, and the color ink COL is ejected by 500 shots, larger than in the flushing area FL1.

In this way, the recovering area is stepwise shifted and finally a flushing area FL4 is reached in which the ink viscosity increase degree is the highest. In this flushing area, the black ink BK is ejected by 5000 shots, and the color ink COL is ejected by 3000 shots to thereby recover the ink ejection ability of the nozzle orifices.

The recovering operations are performed before an operation job is executed. The operation job consists of an ink ejection operation of the recording head H, which ranges from an instant that the recording head H starts an ink ejection in response to an operation command signal applied thereto till the recording head ends the ink ejection. In a specific example where the recording head receives a one-operation command signal, which instructs a print of a letter of 3 pages and starts an ink ejection for printing the letter, an operation of the recording head ranging from the start to the end of the ink injection forms one operation job. The recovering operation in any of the recovering areas is performed before the operation job. In another example where another operation command signal to print a short sentence of about 5 lines after the printing of the letter ends is applied, for another operation job, to the recording head H, the recovering operation in any of the recovering operation areas is performed before the printing operation of the short sentence starts.

When the recovering operation of the recording head shifts from the flushing operation defined by the areas FL1 to FL4 to the cleaning operation, the cleaning operation is performed before the operation job starts. By the cleaning operation, the ink having the considerably increased viscosity is forcibly sucked from the nozzle orifices 2 of the recording head, to thereby recover the normal ink ejection ability of the recording head. After the cleaning operation is performed, a state of the ink at and near the nozzle orifices 2 is returned to a state substantially equal to the initial state that the ink having increased viscosity is removed. Then, the cap leaving time or the printing time is reset, and both the times are counted again from the start.

Although the flushing operation is performed in response to the viscosity increase degree as described above, such consideration is not given to the cleaning operation performed following the flushing operation. Also, consideration is not given either to the point in which some operation condition in the flushing operation is intentionally selected and the cleaning operation is performed depending on the selected operation condition.

SUMMARY OF THE INVENTION

It is therefore an object of the present invention to provide a liquid ejecting apparatus capable of performing cleaning operating fitted to the quality change state of liquid.

In order to achieve the above object, according to the present invention, there is provided a liquid ejecting apparatus, comprising:

a liquid ejecting head, having nozzle orifices for ejecting liquid therefrom; and a controller, which performs a recovery operation, wherein the recovery operation is performed by using at least a flushing operation in which the liquid drops are ejected from the nozzle orifices and a cleaning operation in which a negative pressure is applied to the nozzle orifices; and wherein an operation condition of the cleaning operation is set in accordance with an operation history of the flushing operation performed before the cleaning operation.

That is, in the liquid ejecting apparatus of the invention, an operation condition of the cleaning operation is set in accordance with an operation history of the flushing operation performed before the cleaning operation. Thus, the cleaning operation is performed in accordance with, namely, adapted to the flushing operation history and the cleaning operation fitted to the liquid quality change degree formed based on the operation history is performed. Therefore, the optimized cleaning operation most appropriate for the liquid quality change state when the cleaning operation is performed is executed and the liquid having a changed liquid property, for example, deteriorated liquid, can be prevented from remaining in the nozzle orifices and the vicinities thereof for making insufficient recovery operation or liquid can be prevented from being sucked excessively as waste of fresh liquid.

Preferably, the operation condition of the cleaning operation is set in accordance with the number of times the flushing operation is executed after the preceding cleaning operation. In this configuration, the liquid quality change degree changes depending on the number of flushing operation times and thus the cleaning operation precisely adapted to the change state can be executed. For example, the larger the number of flushing operation times, the more frequently discharged the deteriorated liquid and thus the liquid quality change degree in the nozzle orifices and the vicinities thereof is low. In contrast, the smaller the number of flushing operation times, the less frequently discharged the deteriorated liquid and thus the liquid quality change degree in the nozzle orifices and the vicinities thereof is high. Therefore, the level of the cleaning operation fitted to such a quality change degree is set, whereby good cleaning operation can be accomplished. Thus, as the cleaning operation fitted to the flushing operation history is performed, the cleaning operation corresponding to the real state of the deteriorated liquid in the liquid ejecting apparatus is achieved.

Further, the reason why the "executed flushing operation after the preceding cleaning operation" is used is that most of deteriorated liquid is removed roughly to the initial state as the cleaning operation is performed and thus the number of times the flushing operation was started in the state and has been executed in sequence is used, so that the cleaning operation on which the liquid quality change state is precisely reflected can be executed.

Preferably, the flushing operation the number of times of which is counted is a flushing operation performed before start of a liquid ejecting job or after termination of a liquid ejecting job. In this configuration, the number of times the flushing operation has been executed before start or after termination of a liquid jet job of the essential operation function of the liquid ejecting apparatus is adopted as the operation history and the cleaning operation condition is set in accordance with the number of flushing times, so that the cleaning operation on which the liquid quality change state is precisely reflected can be executed.

Preferably, the operation condition of the cleaning operation is set in accordance with a nonoperating time from the last flushing operation to the current cleaning operation. In this configuration, the liquid quality change degree changes depending on the duration of the nonoperating time and thus the cleaning operation precisely adapted to the change state can be executed. For example, the shorter the nonoperating time, the slighter the liquid quality change development degree and thus the liquid quality change degree in the nozzle orifices and the vicinities thereof is low. In contrast, the longer the nonoperating time, the more severe the liquid quality change development degree and thus the liquid quality change degree in the nozzle orifices and the vicinities thereof is high. Therefore, the level of the cleaning operation fitted to such a quality change degree is set, whereby good cleaning operation can be accomplished. Thus, as the cleaning operation fitted to the flushing operation history is performed, the cleaning operation corresponding to the real state of the deteriorated liquid in the liquid ejecting apparatus is achieved.

Preferably, the last flushing operation is a flushing operation performed before start of a liquid ejecting job or after termination of a liquid ejecting job. In this configuration, the number of times the flushing operation has been executed before start or after termination of a liquid jet job of the essential operation function of the liquid ejecting apparatus is adopted as the operation history and the cleaning operation condition is set in accordance with the number of flushing times, so that the cleaning operation on which the liquid quality change state is precisely reflected can be executed.

Preferably, the operation condition of the cleaning operation is set in accordance with the operation condition of the last flushing operation in at least one flushing operation performed after the preceding cleaning operation. In this configuration, the cleaning operation can be executed more fitted to the liquid quality change degree and thus the level of the cleaning operation is optimized and recovery of the liquid ejecting apparatus can be well accomplished. That is, usually, most of deteriorated liquid is removed roughly to the initial state as the cleaning operation is performed, and thus the operation condition of the last of the flushing operation executed in sequence in the state is fitted to the liquid quality change degree at the time. Therefore, the cleaning operation in accordance with the operation condition of the last flushing operation is performed, whereby the level of the cleaning operation more fitted to the liquid quality change degree is set and the good cleaning operation is executed.

Preferably, the last flushing operation is a flushing operation performed before start of a liquid ejecting job or after termination of a liquid ejecting job. In this configuration, the number of times the flushing operation has been executed before start or after termination of a liquid jet job of the essential operation function of the liquid ejecting apparatus is adopted as the operation history and the cleaning operation condition is set in accordance with the number of flushing times, so that the cleaning operation on which the liquid quality change state is precisely reflected can be executed.

Preferably, the operation condition of the flushing operation is set in accordance with a relation between a first cumulative time for which the nozzle orifices are left in a sealed state and a second cumulative time for which a liquid ejection is executed. In this configuration, the flushing operation condition set under the accordance between both the cumulative times is set as the operation condition precisely fitted to the liquid quality change degree. Therefore, the cleaning operation in accordance with the operation condition is performed, whereby the cleaning operation becomes more fitted to the real state of the liquid quality change degree and the optimized level of the cleaning operation is achieved accordingly.

Preferably, the operation condition of the last flushing operation is set so as to change the amount of the liquid ejected from the nozzle orifices.

Preferably, the operation condition of the cleaning operation is set in accordance with an environmental condition having at least one of temperature and humidity at an installed location of the liquid ejecting apparatus. In this configuration, the operation condition is set also fitted to the environmental conditions of the temperature and the humidity and thus the optimum operation condition fitted to all surrounding conditions can be set, making it possible to perform the cleaning operation most corresponding to the liquid quality change state.

Preferably, the operation condition of the cleaning operation is set so as to change the amount of the liquid sucked from the nozzle orifices. In this configuration, the liquid suction amount is increased or decreased in accordance with the liquid quality change degree, etc. Therefore, the liquid suction amount optimized for removing the deteriorated liquid in the nozzle orifices and the vicinities thereof is secured and good cleaning operation can be accomplished.

Preferably, the amount of the liquid sucked from the nozzle orifices in the cleaning operation is in proportion to degrees in change of a liquid property of the liquid. In this configuration, the suction amount precisely adapted to the real state of liquid quality change can be secured and thus it is made possible to perform the cleaning operation most corresponding to the liquid quality change state. The quality change area is previously classified into a plurality of areas, whereby the optimized cleaning operation responsive to the quality change degree class can be executed.

Preferably, the recovery operation is performed before start of a job which executes a liquid ejection based on one operation command signal applied to the liquid electing head as an operation unit. In this configuration, the recovery operation of cleaning or flushing is always performed before start of a job and thus recovery in the nozzle orifices and the vicinities thereof is reliably accomplished, and liquid can always be jetted in the best state.

Preferably, the liquid is ink for printing and the liquid ejecting apparatus is an ink jet recording apparatus. In this configuration, the cleaning operation as described above is applied to the ink quality change, normal ink droplets are ejected, and good print quality can be provided.

Preferably, the ink becomes a ink having a changed ink property in a state that the viscosity of the ink is increased on the nozzle orifices and the vicinities thereof. In this configuration, in the area in which ink is put into high viscosity requiring the cleaning operation, the ink having a high viscosity in the nozzle orifices and the vicinities thereof in the record head of the ink jet record apparatus is removed by the cleaning operation, and it is made possible to eject normal ink droplets. The cleaning operation is executed in accordance with, namely, adapted to the flushing operation history and the cleaning operation fitted to the ink quality change degree formed based on the operation history is performed. Therefore, the optimized cleaning operation most appropriate for the ink quality change state when the cleaning operation is performed is executed and the deteriorated ink can be prevented from remaining in the nozzle orifices and the vicinities thereof for making insufficient recovery operation or ink can be prevented from being sucked excessively as waste of fresh ink.

BRIEF DESCRIPTION OF THE DRAWINGS

The above objects and advantages of the present invention will become more apparent by describing in detail preferred exemplary embodiments thereof with reference to the accompanying drawings, wherein:

FIG. 4A is a schematic representation to show mode selection conditions based on the leaving time and the print time, FIG. 4B is a correspondence table between the number of flushing times and cleaning mode, and FIG. 4C is a correspondence table between the nonoperating time and cleaning mode;

FIG. 7A is a schematic representation to show mode selection conditions based on the leaving time and the print time and FIG. 7B is a correspondence table between flushing mode and cleaning level.

DETAILED DESCRIPTION OF THE PREFERRED EMBODIMENTS

Embodiments of the present invention will be described in detail.

The accompanying drawings show embodiments of liquid ejecting apparatus of the present invention and FIGS. 1 to 5 show a first embodiment of the present invention.

A liquid ejecting apparatus of the invention is operable to eject any of various kinds of liquids, as described above. In an illustrated embodiment, the liquid ejecting apparatus is typically applied to an ink jet recording apparatus.

Figure 1:
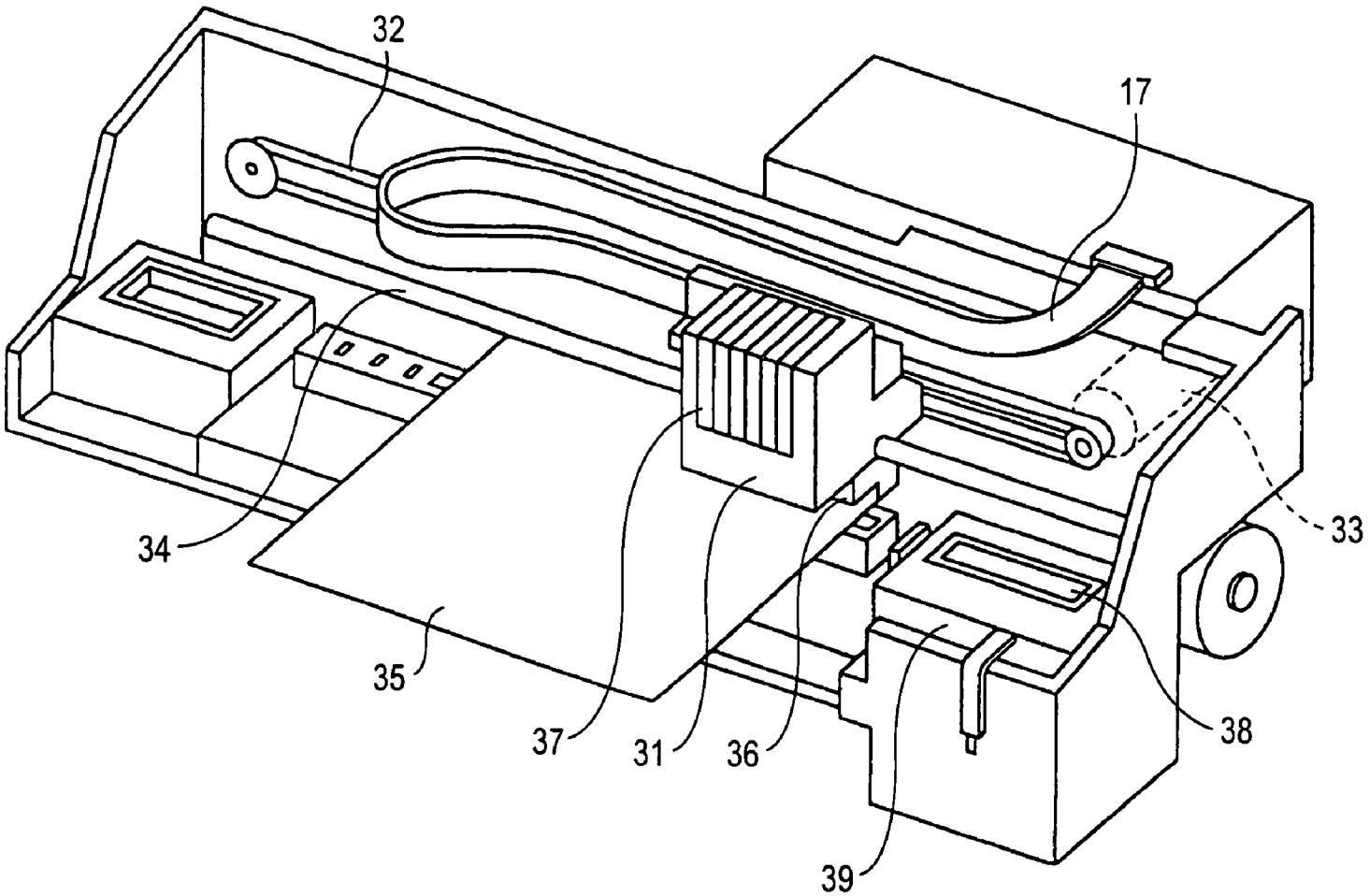
FIG. 1 is a perspective view to show an ink jet record apparatus according to a first embodiment of the invention.
Figure 2:
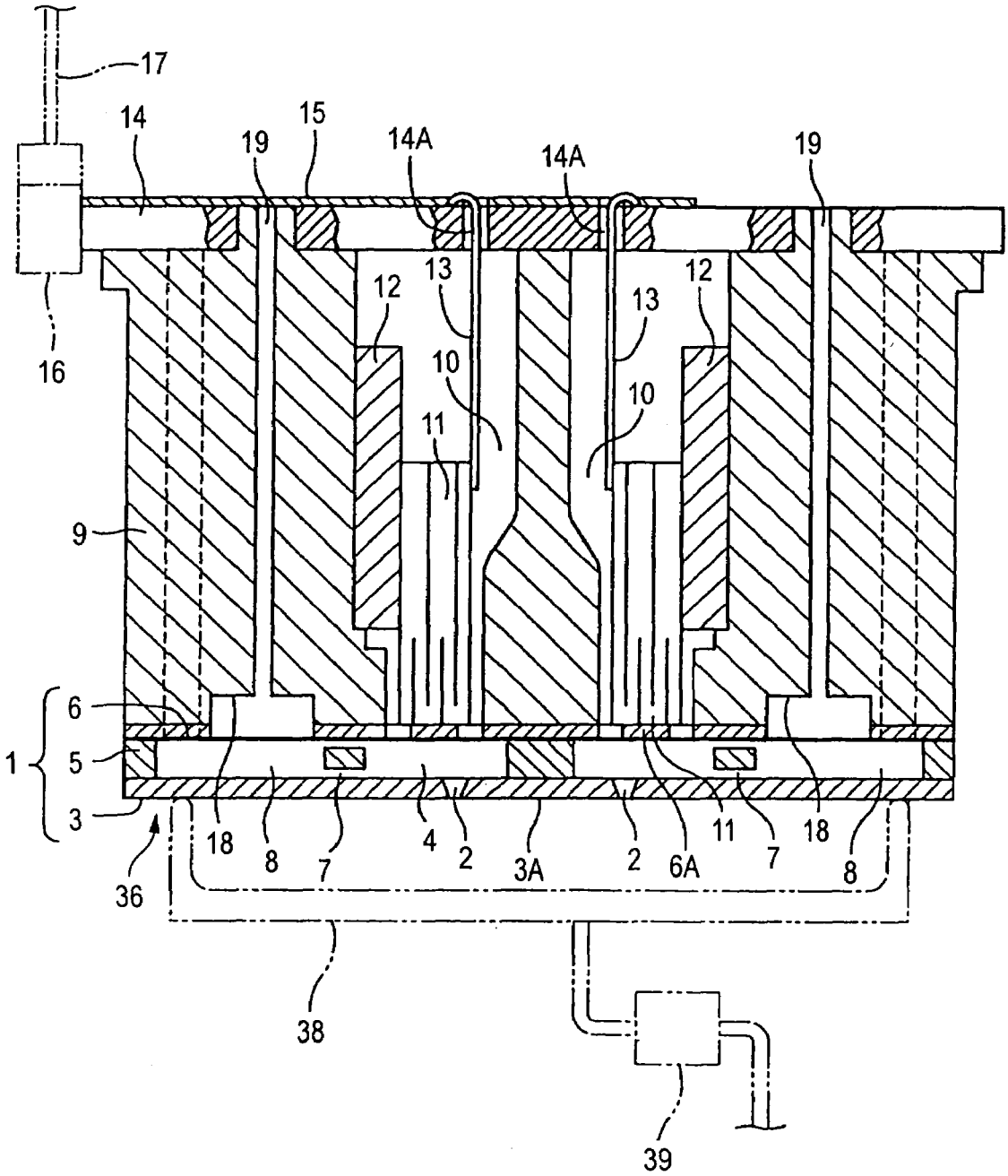
FIG. 2 is a sectional view to show an example of a record head of the ink jet record apparatus.
Figure 8:
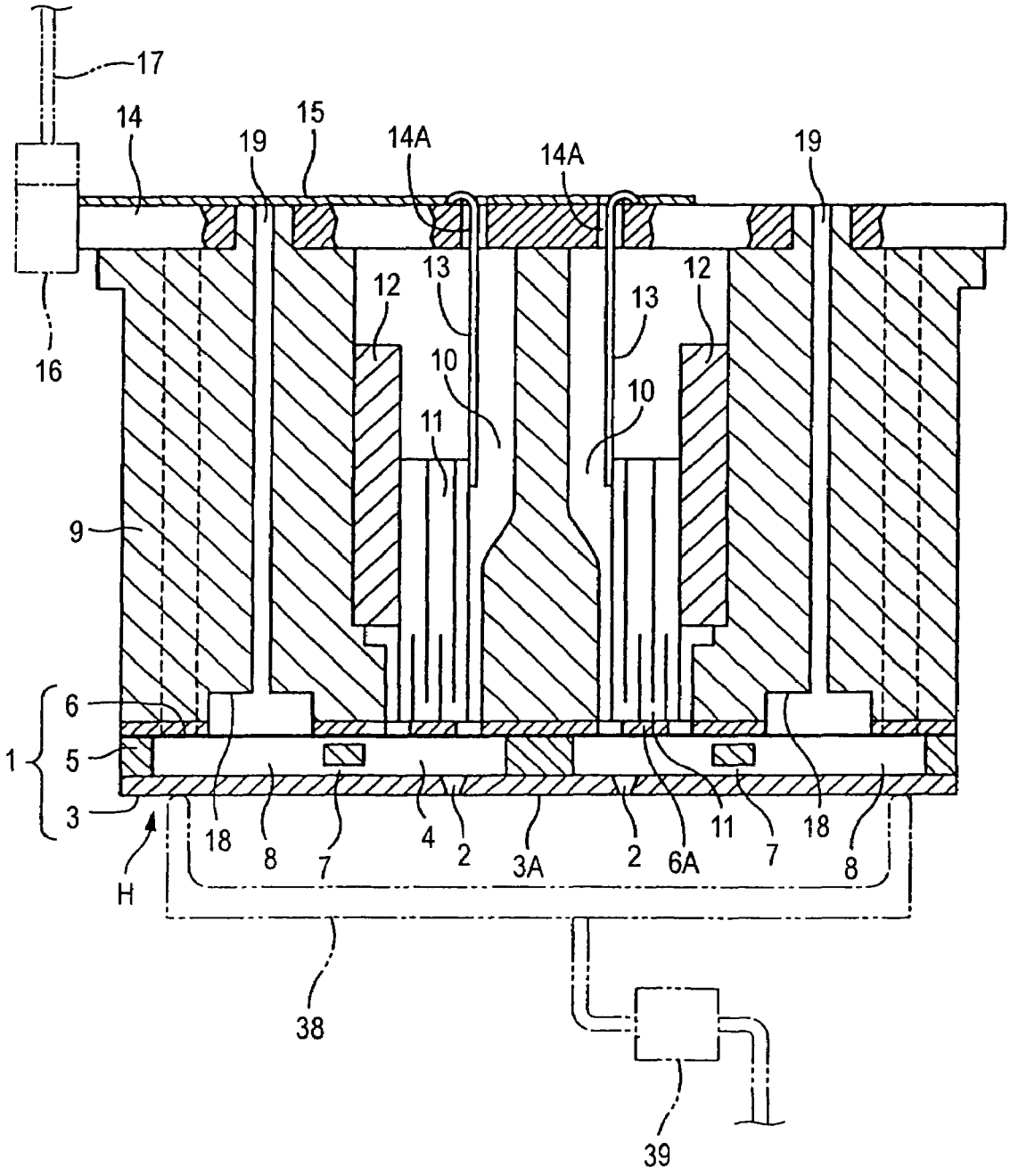
FIG. 8 RELATED ART
FIG. 8 is a sectional view to show a record head of a related ink jet record apparatus.
Figure 9:
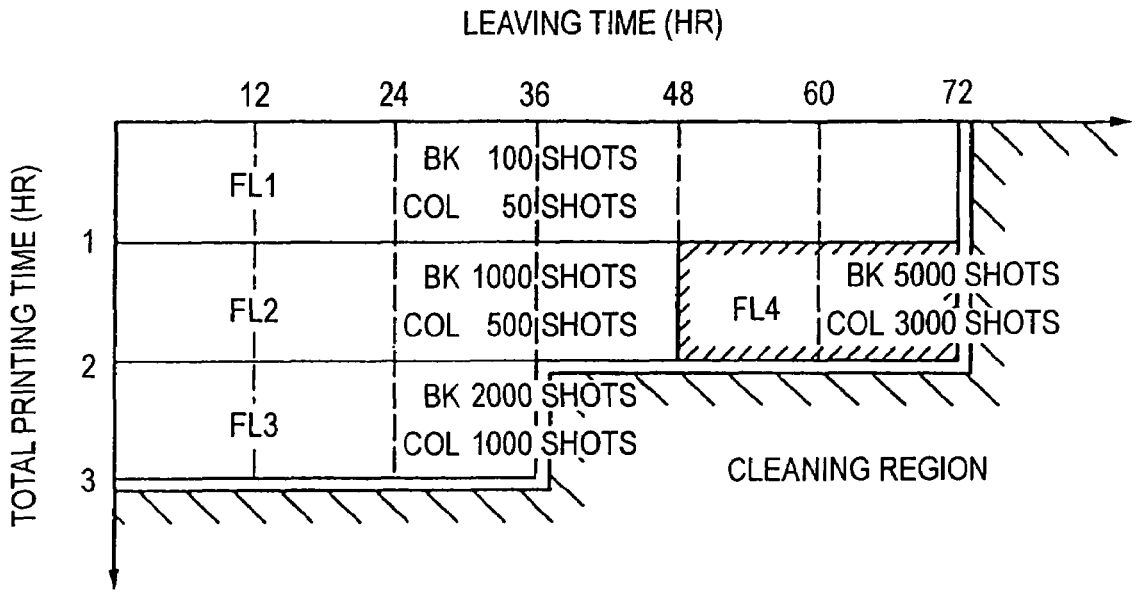
FIG. 9 RELATED ART
FIG. 9 is a schematic representation to show mode selection conditions based on the leaving time and the print time in the related ink jet record apparatus.

FIG. 1 is a perspective view showing a peripheral structure of an ink jet recording apparatus according to the present invention. FIG. 2 is a cross sectional view showing a recording head 36, which is similar to the recording head H already described referring to FIG. 8. In FIG. 8, like or equivalent portions are designated by like reference numerals used in FIG. 2.

The ink jet recording apparatus includes a carriage 31 and a capping device 38. The carriage 31 includes six ink cartridges 37 mounted in an upper part thereof, and a recording head 36 mounted on a lower surface thereof. The capping device 38 is provided for sealing the recording head 36. In the embodiment, six ink cartridges 37 containing respectively cyan (C), light cyan (LC), magenta (M), light magenta (LM), yellow (Y), and black (BK) are mounted on the carriage.

The carriage 31 is coupled to a stepping motor 33 by a timing belt 32, and is reciprocatively moved in a width direction of a recording sheet 35, while being guided by a guide bar 34. The recording head 36 is mounted on a surface (lower surface in this instance) of the carriage 31, which faces the recording sheet 35. Inks are fed to the recording head 36, from the ink cartridges 37. The recording head ejects ink drops onto the recording sheet 35, while moving the carriage 31, to thereby images and characters are printed on the recording sheet 35 by a dot matrix method.

The capping device 38 is located in a non-print area within a movement range of the carriage 31. When the recording head is not used or operated for printing, the capping device seals the nozzle orifices 2 for preventing the drying of the nozzle orifices 2. The capping device 38 is also used as a receptacle for receiving ink drops that is ejected from the recording head 36 in the flushing operation. Further, the capping device 38 is coupled to a suction pump 39. In the cleaning operation, the capping device applies a negative pressure to the nozzle orifices 2 of the recording head 36 so that the ink is sucked from the nozzle orifices 2.

FIG. 2 is a cross sectional view showing an example of the recording head 36. The recording head 36 is similar to the recording head H already described referring to FIG. 8. In FIG. 8, like or equivalent portions are designated by like reference numerals used in FIG. 2. In the figure, the capping device 38 and the suction pump 39 are indicated by two-dot chain lines.

Figure 3:
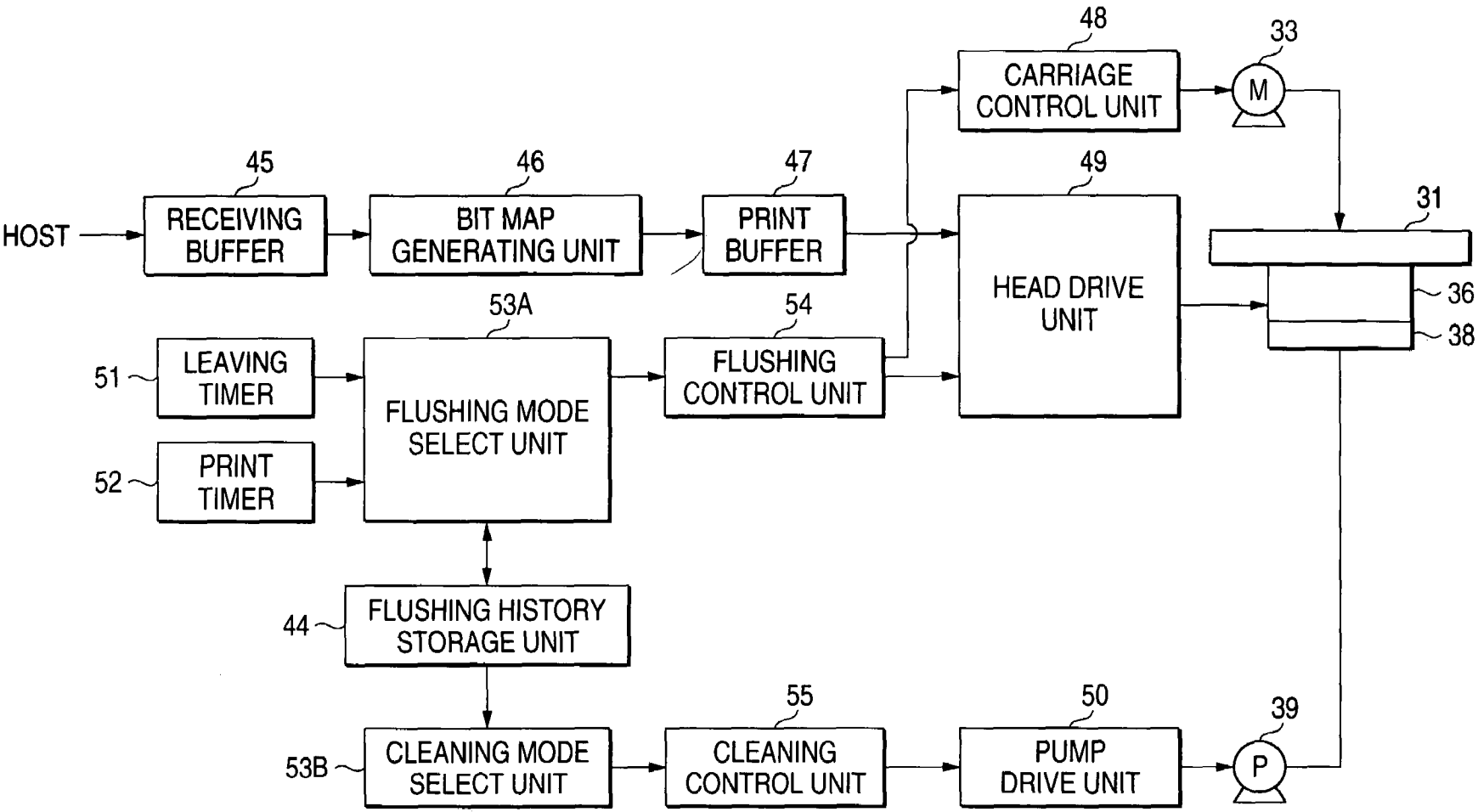
FIG. 3 is a block diagram to show the system configuration of the ink jet record apparatus of the invention.

FIG. 3 is a block diagram showing a system configuration of the ink jet recording apparatus. In the figure, a receiving buffer 45 receives print data from a host computer (not shown), a bit map generating unit 46 converts the print data into bit map data, and a print buffer 47 temporarily stores the bit map data.

Reference numeral 49 designates head drive unit. The head drive unit executes a printing operation in which a drive signal is applied to the pressure generating element 11 so that ink drops are ejected from the recording head 36 in accordance with a print signal from the print buffer 47.

Further, at a timing of the flushing operation, the head drive unit executes the flushing operation in which a drive signal is applied to the pressure generating element 11 independently of a print signal so that ink drops are ejected from the nozzle orifices 2 of the recording head 36.

Reference numeral 50 designates a pump drive unit. The pump drive unit 50 executes a cleaning operation in which a negative pressure is applied from the suction pump 39 to the recording head 36 when the recording head 36 is sealed with the capping device 38 to forcibly suck the ink from the nozzle orifices 2.

Reference numeral 48 designates carriage control unit. At the time of printing, the carriage control unit 48 drives a stepping motor 33 which in turn moves the carriage 31 to scan the recording head 36. Further, in the flushing operation or at the end of printing, the carriage control unit 48 moves the carriage 31 to a position where the capping device 38 is confronted with the recording head 36.

Reference numeral 51 designates a cap leaving timer. When it is detected, based on a signal from the carriage control unit 48 or the like, that the recording head 36 is sealed with the capping device 38, the cap leaving timer 51 is driven to measure a cap leaving time that the recording head 36 is left while being sealed with the capping device 38. The leaving timer 51 measures a cumulative time containing the time for which the nozzle orifices 2 are left in a state that the nozzle orifices 2 are sealed from the time at which the preceding cleaning operation is performed and the print time (hereinafter, a cumulative time will be referred to as "leaving time") and is reset when the cleaning operation is executed.

Reference numeral 52 is a print timer. When a start of printing operation is detected by use of signals from the head drive unit 49 and the carriage control unit 48 or the like, the print timer 52 is driven to measure a printing time ranging from an instant that the recording head 36 is released from the capping device 38 till the recording head 36 is sealed with the capping device 38 again. Specifically, the print timer 52 measures a cumulative time (referred to as a "total printing time") that the ink drops are ejected, and is reset at a time point that the cleaning operation is executed.

Reference numeral 53A indicates mode select unit. The mode select unit 53A receives signals representative of a leaving time and a total printing time from the cap leaving timer 51 and the print timer 52, and selects a flushing mode to perform the flushing operation on the basis of a relation between the leaving time and the total printing time under various conditions described later, and outputs a signal indicating the selected mode.

Reference numeral 54 is flushing control unit. The flushing control unit 54 receives a signal from the flushing mode select unit 53A, and causes the head drive unit 49 to apply a drive voltage to the pressure generating element 11. Upon receipt of the drive signal, the pressure generating element 11 is repeatedly expanded and contracted to vibrate. And, the flushing control unit 54 controls the flushing operation in which the recording head is caused to eject ink drops from the nozzle orifices 2 under various conditions.

Figures 4A, 4B, 4C:
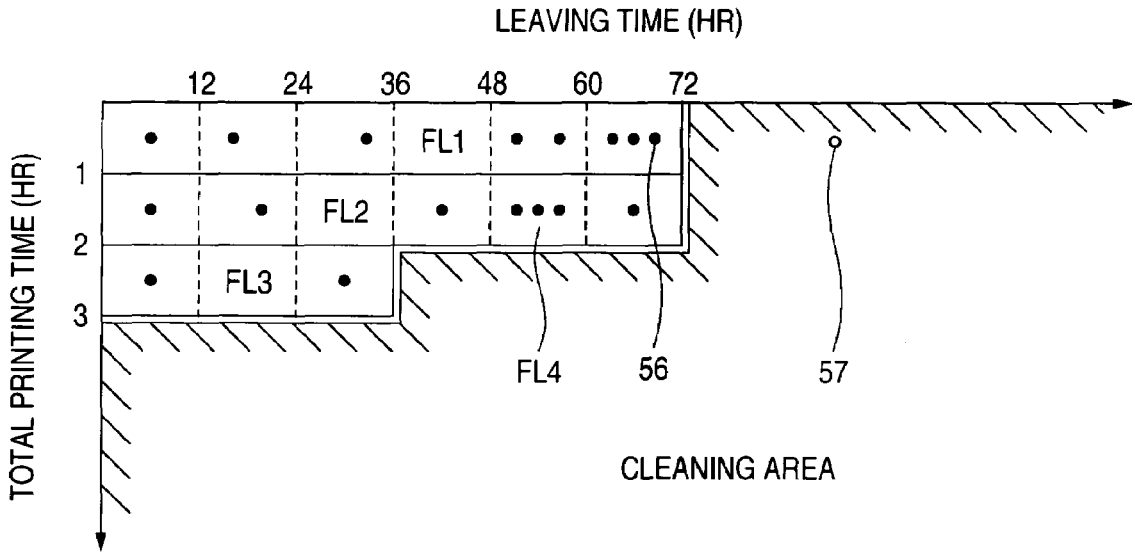
FIGS. 4A to 4C are drawings to show operation modes in the ink jet record apparatus.

FIG. 4A is a schematic representation to show an example of mode selection conditions of each mode set based on the relataion between the leaving time and the total printing time in the ink jet record apparatus. In this example, flushing modes (flushing area) at four stages of FL1 to FL4 and a cleaning area exceeding the flushing modes are set according to the relation between the leaving time and the total printing time.

In the example, the reference value of the total printing time (Hr) is set to three steps of one, two, and three hours, and the reference value of the leaving time (Hr) is set to six steps of 12, 24, 36, 48, 60, and 72 hours. The area hatched in FIG. 4 is set to the cleaning area in which the cleaning mode is selected. The shorter time side than the cleaning mode is set to the flushing area in which the flushing operation is executed.

A mode FL1 in the flushing area is defined by the total printing time of smaller than 1 hour and the leaving time of smaller than 72 hours. A mode FL2 is defined by the total printing time from 1 hour to a time value of smaller than 2 hours, and the leaving time of smaller than 48 hours. A mode FL3 is defined by the total printing time from 2 hours to a time value of smaller than 3 hours, and the leaving time of smaller than 36 hours. A mode FL4 is defined by the total printing time from 1 hour to a time value of smaller than 2 hours, and the leaving time from 48 hours to a time value of smaller than 72 hours.

In the flushing operation of the modes FL1 to FL4, an amount of ejected ink may be defined by using a continuous ink ratio. In the embodiment, however, the ink of the highly increased viscosity is removed by instantaneous ejections of ink of a pulsatory ink ratio. Accordingly, the ink ejection amount is expressed in terms of the number of ink ejections, i.e., the number of shots of ink.

The flushing conditions in the modes FL1 to FL3 are exemplarily listed below:

| | | |
|---|---|---|
| Mode FL1 | black ink (BK) | 100 shots/nozzle |
| | color ink (COL) | 50 shots/nozzle |
| Mode FL2 | black ink (BK) | 1000 shots/nozzle |
| | color ink (COL) | 500 shots/nozzle |
| Mode FL3 | black ink (BK) | 2000 shots/nozzle |
| | color ink (COL) | 1000 shots/nozzle |
| Mode FL4 | black ink (BK) | 5000 shots/nozzle |
| | color ink (COL) | 3000 shots/nozzle |

Referring again to FIG. 3, reference numeral 44 denotes flushing history storage unit for storing an operation history of flushing selected in the flushing mode select unit 53A and executed in each mode FL1 to FL4 by the flushing control unit 54. As the flushing operation history, the number of times the flushing operation has been executed after the preceding cleaning operation is counted and is stored in the flushing history storage unit 44. The number of flushing times is reset to zero as the cleaning operation is executed, and is accumulated and the cumulative sum is stored until the next cleaning operation is executed. The number of flushing times stored in the flushing history storage unit 44 is the number of times the flushing operation has been executed before start of a print job or after termination of a print job, and is not the number of shot times in each mode FL1 FL1 to FL4.

As the flushing operation history, the nonoperating time from the preceding flushing operation is stored in the flushing history storage unit 44. The nonoperating time stored in the flushing history storage unit 44 is reset to zero as the flushing operation is executed, and is measured and is stored until the next cleaning operation is executed.

Which mode of FL1 to FL4 the preceding flushing operation was executed in, namely, the preceding executed flushing mode is stored in the flushing history storage unit 44. The stored flushing mode is updated as the next flushing operation is executed. The cleaning mode can be selected in accordance with the last executed flushing mode together with the number of flushing times or the nonoperating time.

Reference numeral 53B denotes cleaning mode select unit for selecting a cleaning mode corresponding to the number of flushing times or the nonoperating time read from the flushing history storage unit 44.

In the example, as the cleaning modes, CL1 to CL3 are set according to difference in the ink suction amount. The cleaning modes are set so that CL1 corresponds to the smallest suction amount and CL2 and CL3 correspond to the larger suction amounts in order (CL2<CL3).

For example, as shown in FIG. 4B, if the number of flushing times read from the flushing history storage unit 44 is 10 or less, CL3 can be selected; if the number of flushing times is 11 or more and 100 or less, CL2 can be selected; and if the number of flushing times is 101 or more, CL1 can be selected.

For example, as shown in FIG. 4C, if the nonoperating time read from the flushing history storage unit 44 (namely, the time from the point in time of the last executed flushing operation after the preceding cleaning operation (black spot 56 in FIG. 4A) to the point in time of the current cleaning (white spot 57 in FIG. 4A)) is less than 10 hours, CL1 can be selected; if the nonoperating time is 10 hours or more and 100 hours or less, CL2 can be selected; and if the nonoperating time is 100 hours or more, CL3 can be selected.

Reference numeral 55 denotes cleaning control unit for receiving a signal from the cleaning mode select unit 53B and controlling the cleaning operation of the pump drive unit 50. The cleaning control unit 55 executes the cleaning operation responsive to the number of flushing operation times, and the nonoperating time from the point in time of the last flushing operation to the current cleaning operation read from the flushing history storage unit 44, etc.

The number of flushing operation times previously described with reference to FIG. 4 can be the number of times the flushing operation has been executed before start or after termination of a print job. The number of the flushing operation times has been executed before start or after termination of a print job of the essential operation function of the ink jet record apparatus is adopted as the operation history and the cleaning operation condition is set in accordance with the number of flushing times, so that the cleaning operation on which the ink quality change state is precisely reflected can be executed.

When the cleaning operation has been executed, the already stored number of flushing operation times is reset to zero; likewise, when manual cleaning operation has been executed, the already stored number of flushing operation times is also reset. For the manual operation, the number of times is also reset when the flushing operation area is entered.

Next, an example of the operation of the ink jet record apparatus will be discussed with reference to a flowchart of FIG. 5. In the figure, S means a procedural step.

In the embodiment, the number of times the flushing operation has been performed is adopted as the flushing operation history.

First, a print signal of one job is input from the host and when the print job is started, the leaving timer 51 detects the leaving time and the print timer. 52 detects the total printing time (S1 and S2). Next, the flushing mode select unit 53A determines whether or not the flushing operation is in the mode FL1 area based on the relation between the leaving time and the total printing time (see FIG. 4) (S3). If the flushing operation is in the mode, the FL1 mode is selected (S4) and the flushing operation in the mode FL1 is executed (S5) and then print is executed (S28). If it is determined at step S3 that the flushing operation is not in the mode FL1 area, a transition is made to determination as to whether or not the flushing operation is in the mode FL2 area (S6).

If the flushing operation is in the FL2 mode at step S6, the FL2 mode is selected (S7) and the flushing operation in the mode FL2 is executed (S8) and then print is executed (S28). If it is determined at step S6 that the flushing operation is not in the mode FL2 area, a transition is made to determination as to whether or not the flushing operation is in the mode FL3 area (S9).

If the flushing operation is in the FL3 mode at step S9, the FL3 mode is selected (S10) and the flushing operation in the mode FL3 is executed (S11) and then print is executed (S28). If it is determined at step 89 that the flushing operation is not in the mode FL3 area, a transition is made to determination as to whether or not the flushing operation is in the mode FL4 area (S12).

If it is determined at step S12 that the flushing operation is in the FL4 mode, then whether or not the job is the first job after the power is turned on is determined (S13). If the job is determined the first job, the FL4 first-time mode is selected (S14) and the first flushing operation in the mode FL4 is executed (S15) and then print is executed (S28). The first-time mode FL4 is the first job executed after the power is turned on, and the possibility that a considerable time has elapsed since the preceding use is high. Thus, the viscosity of ink in the nozzle orifices 2 and the vicinities thereof is remarkable high and therefore the first flushing operation is executed the predetermined number of shot times (5000 shots of black ink (BK), 3000 shots of color ink (COL)) as the number of shot times illustrated above.

If it is determined at step S13 that the job is not the first job, the second or later time mode of FL4 is selected (S16) and the second or later flushing operation in the mode FL4 is executed (S17) and then print is executed (S28). The second or later time mode FL4 is executed following the preceding job with the power on and the flushing operation in the FL4 first-time mode was already once performed. Thus, the viscosity of ink in the nozzle orifices 2 and the vicinities thereof is recovered to some extent by the first flushing operation and therefore the flushing operation is executed, for example, 1000 shots of black ink (BK), 500 shots of color ink (COL) falling drastically short of 5000 shots of black ink (BK), 3000 shots of color ink (COL)) at the first time.

While use of the record apparatus is continued with the power on and the flushing mode each time a job is started is the FL4 area, the flushing operation in the FL4(second or later mode) is continuously executed as the flushing operation in the FL4 area.

Next, an operation of the cleaning area will be discussed.

If it is determined at step S12 that the flushing operation is not in the FL4 mode area, a transition is made to reading of the number of flushing times (S18) and the number of flushing times stored in the flushing history storage unit 44 is read. The cleaning mode select unit 53B selects and sets the corresponding cleaning mode (any of CL1 to CL3) depending on which of the number-of-times classes listed in the correspondence table in FIG. 4B corresponds to the read number of times. The cleaning operation responsive to the number of flushing times is executed.

That is, first, whether or not the number of flushing times is up to 10 is determined (S19). If the number of flushing times is in this range, the CL3 mode of the cleaning operation of the ink suction amount corresponding to the number of times is selected (S20) and the cleaning operation in the mode CL3 is executed (S21) and then print is executed (S28).

The CL mode is the cleaning operation condition. In the example, three CL modes of CL3, CL2, and CL1 are available and the ink suction amount becomes smaller in the order of CL3, CL2, and CL1 as previously described with reference to FIG. 4B. Since the number of flushing times is small in the range of 1 to 10 flushing times (smallest), there is a possibility that the recovery degree of ink having the high viscosity as the flushing operation is performed will become insufficient. Then, the cleaning operation rank is raised, namely, the cleaning operation corresponding to the flushing operation history is executed with the ink suction amount increased in the CL3 mode with the strongest suction force or for prolonged suction time.

If it is determined at step S19 that the number of flushing times is not in the range of up to 10, whether or not the number of flushing times is in the range of 11 to 100 is determined (S22). If the number of flushing times is in this range, the CL2 mode of the cleaning operation of the ink suction amount corresponding to the number of times is selected (S23) and the cleaning operation in the mode CL2 is executed (S24) and then print is executed (S28). If the flushing operation history indicates the number of flushing times in the range of 11 to 100, ink having the high viscosity is removed at a considerable level and thus the cleaning operation is executed with a smaller ink suction amount than that in the CL3 mode at the CL2 mode level as the cleaning operation corresponding to the flushing operation history.

If it is determined at step S22 that the number of flushing times is not in the range of 11 to 100, whether or not the number of flushing times is 101 or more is determined (S25). If the number of flushing times is 101 or more, the CL1 mode of the cleaning operation of the ink suction amount corresponding to the number of times is selected (S26) and the cleaning operation in the mode CL1 is executed (S27) and then print is executed (S28). If the flushing operation history indicates the number of flushing times in the range of 101 or more, ink having the high viscosity is removed at a higher level and thus the cleaning operation is executed with a smaller ink suction amount than that in the CL2 mode at the CL1 mode level as the cleaning operation corresponding to the flushing operation history.

The cleaning operation is executed, whereby the leaving timer 51 and the print timer 52 are reset and the leaving time and the total printing time are reset to zero.

In the operation description given above, the cleaning operation mode (level) is selected based on the total number of flushing operation times independently of classification of FL1 to FL4; on the other hand, the cleaning operation condition can be set in accordance with FL1 to FL4 of the flushing operation condition. The black spot shown in FIG. 4A represents the instant when the flushing operation was executed. The number of black spots indicates the number of times the flushing operation has been executed and the black spot denoted by the numeral 56 represents the last executed flushing operation after the preceding cleaning operation. The flushing mode select unit 53A stores the correspondence between the flushing operation 56 and any mode of FL1 to FL4 in the flushing history storage unit 44 and the cleaning mode select unit 53B sets the cleaning operation condition in accordance with the mode (any of FL1 to FL4).

That is, in the example shown in FIG. 4, the last flushing operation 56 is performed at the mode FL1 and therefore a comparatively small ink suction amount is set. If the last flushing operation 56 is performed at the mode FL4 , the largest ink suction amount is set.

The reason why the "executed flushing operation after the preceding cleaning operation" is used is that most of ink having the high viscosity is removed roughly to the initial state as the cleaning operation is performed and thus the number of times the flushing operation was started in the state and has been executed in sequence is used, so that the ink quality change state can be grasped precisely.

Figure 6:
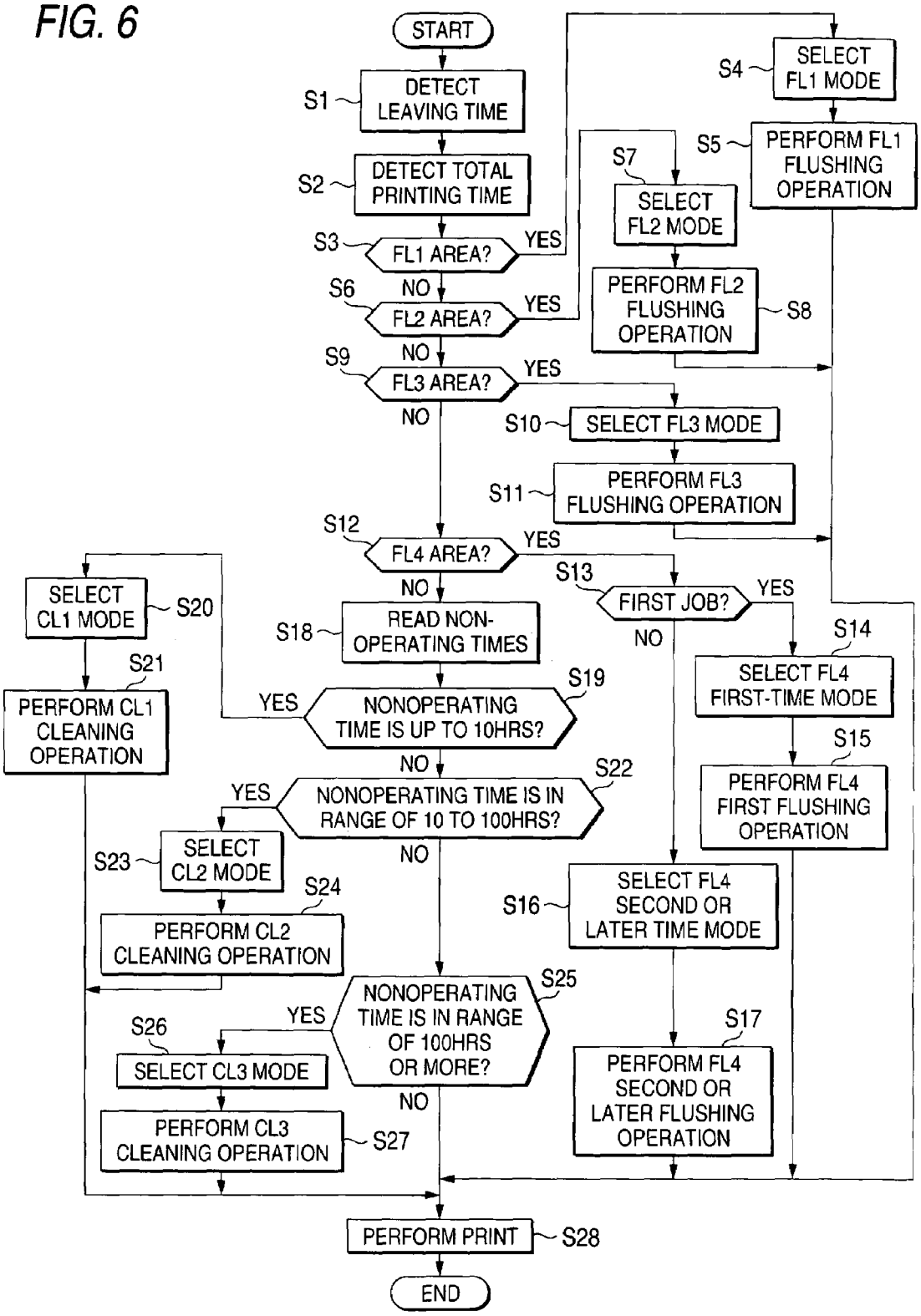
FIG. 6 is a flowchart to show an operation of the ink jet record apparatus according to second embodiment of the invention.

FIG. 6 shows an operation of the ink jet record apparatus according to the second embodiment.

In this embodiment, the nonoperating time from the point in time of the last flushing operation to the point in time of the current cleaning is adopted as the flushing operation history.

Figures 7A, 7B:
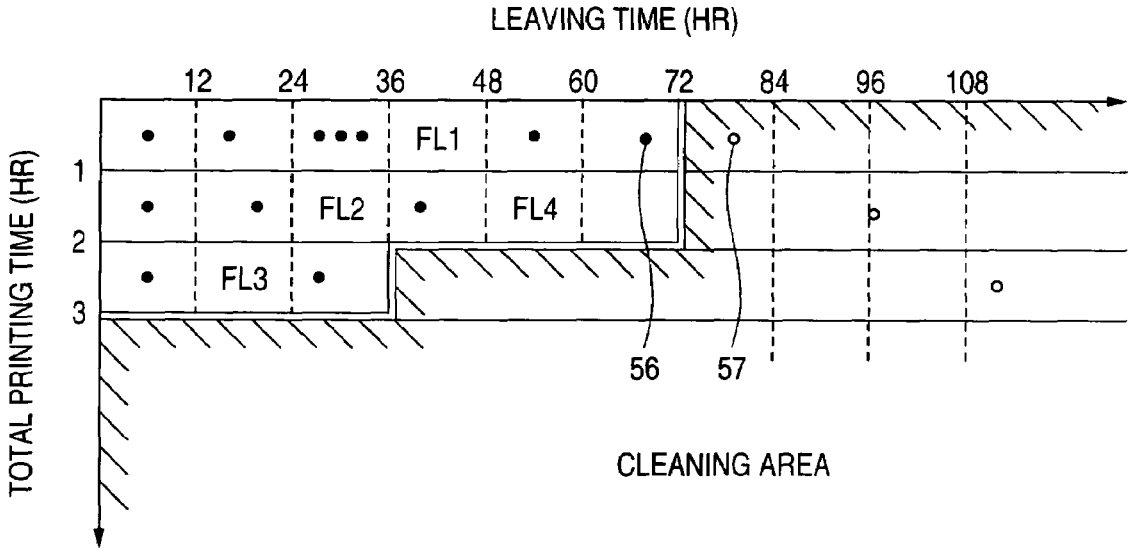
FIGS. 7A to 7B are drawings to show operation modes in the ink jet record apparatus.

As shown in FIG. 7A, the nonoperating time is the time from the point in time 56 of the last flushing operation, here, intensive flushing after termination of print job to the point in time 57 of the current cleaning, here, flushing before termination of print job, and the cleaning operation condition is set in accordance with the time. Therefore, if the nonoperating time is short, the degree of in increased ink viscosity is comparatively slight and thus the cleaning operation becomes a comparatively small ink suction amount. If the nonoperating time is long, the cleaning operation becomes a large ink suction amount.

If it is determined at step S12 in FIG. 6 that the flushing operation is not in the mode FL4 area, a transition is made to reading of the nonoperating time (SIB) and the nonoperating time stored in the flushing history storage unit 44 is read. The cleaning mode select unit 53B selects and sets the corresponding cleaning mode (any of CL1 to CL3) depending on which of the nonoperating time classes listed in the correspondence table in FIG. 4C is corresponds to the read nonoperating time, and the cleaning operation responsive to the duration of the nonoperating time is executed.

The operation differs from that previously described with reference to the flowchart of FIG. 5 in that the nonoperating time rather than the number of flushing operation times is adopted as the operation history and determination is made in three steps of the duration of the nonoperating time, for example, less than 10 hours, 10 hours or more and less than 100 hours, and 100 hours or more. If the nonoperating time is prolonged, the ink suction amount in the CL mode set in the cleaning mode select unit 53B is also increased.

Figure 5:
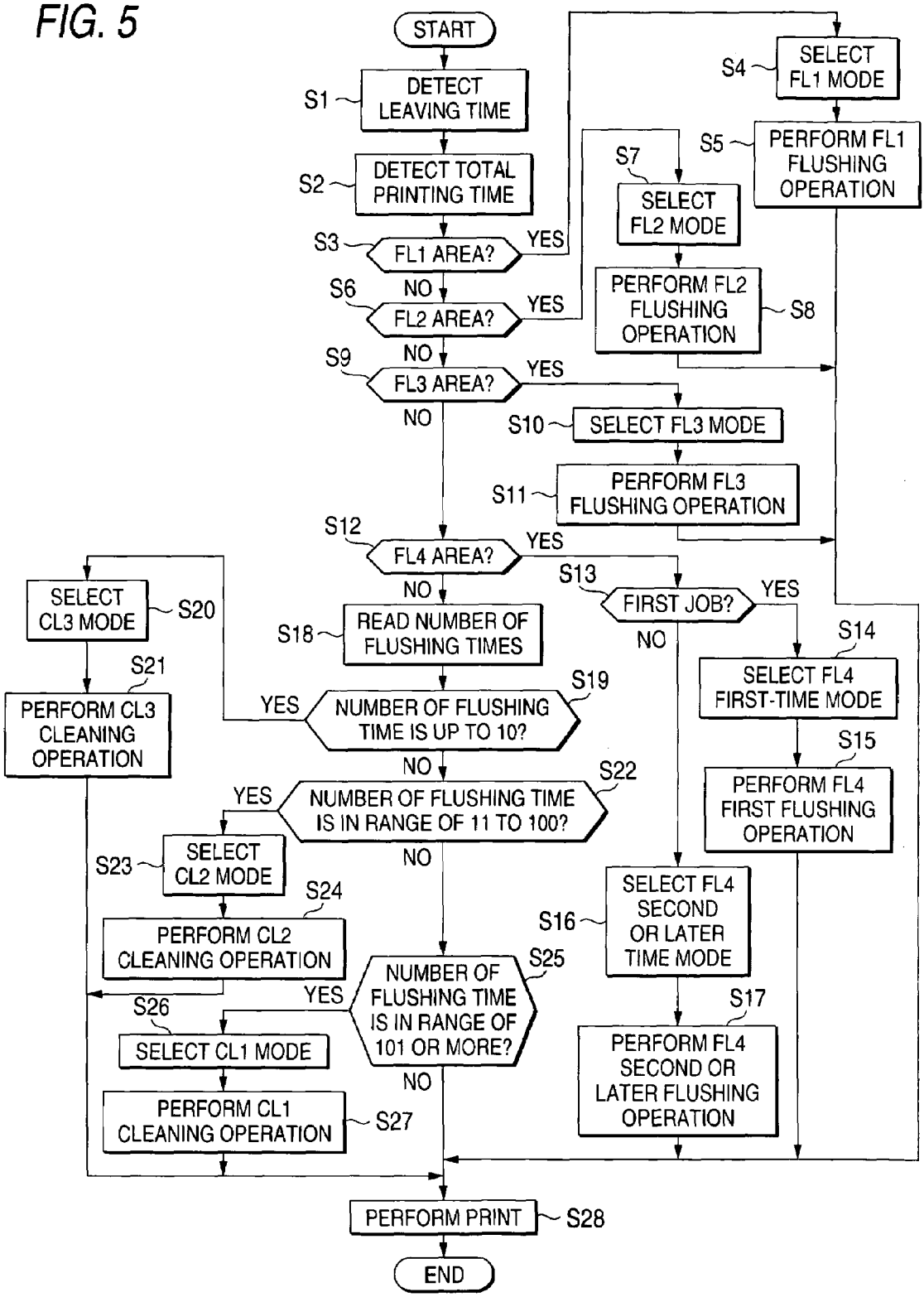
FIG. 5 is a flowchart to show the operation of the ink jet record apparatus.

In the operation description given above with reference to the flowcharts of FIGS. 5 and 6, the cleaning operation mode (level) is selected based on the duration of the nonoperating time independently of classification of FL1 to FL4. On the other hand, the cleaning operation condition can be set in accordance with FL1 to FL4 of the flushing operation condition. The black spot shown in FIG. 7A represents the instant when the flushing operation was executed. The number of black spots indicates the number of times the flushing operation has been executed and the black spot 56 represents the last executed flushing operation after the preceding cleaning operation. The correspondence between the last flushing operation 56 (namely, the preceding flushing operation) and any mode of FL1 to FL4 can be stored in the flushing history storage unit 44 and the cleaning operation condition can be set in accordance with the mode (any of FL1 to FL4).

In FIG. 7A, the last flushing operation 56 is performed at the mode FL1 and therefore a comparatively small ink suction amount is set. If the last flushing operation 56 is performed at the mode FL4 and the nonoperating time is set, preferably the largest ink suction amount is set.

For example, in the table in FIG. 7B, the cleaning mode is set based on the nonoperating time and the last executed flushing mode. In each mode, as the nonoperating time is prolonged, the cleaning operation level is raised and the ink suction amount is increased in proportion to the raised level. For example, in the mode FL1, the level of the cleaning operation is raised in response to an increase in the nonoperating time like CL1, CL2, and CL3. In the mode FL2, the level of the cleaning operation is raised in response to an increase in the nonoperating time like CL2, CL3, and CL4. The level of the cleaning operation is raised in order as listed in the table. As the flushing operation condition is raised like FL1 to FL4, the cleaning operation level is also shifted so that it is raised stepwise.

In FIG. 7B, CL1 to CL6 are set, however, which can be reduced to CL1 to CL3; CL1 can be executed twice as CL4, CL2 can be executed twice as CL5, and CL3 can be executed twice as CL6 for providing the steps CL4 to CL6. In doing so, operation memory of the cleaning operation sequence can be saved.

According to the embodiment, the cleaning operation condition is set in accordance with the operation history of the flushing operation executed before the cleaning operation. Thus, the cleaning operation is executed in accordance with, namely, adapted to the flushing operation history and the cleaning operation fitted to the ink quality change degree formed by the operation history is performed. Therefore, the optimized cleaning operation most appropriate for the ink quality change state when the cleaning operation is performed is executed. The deteriorated ink can be prevented from remaining in the nozzle orifices 2 and the vicinities thereof for making insufficient recovery operation or ink can be prevented from being sucked excessively as waste of fresh liquid.

Since the ink quality change degree is different depending on the number of flushing operation times, the cleaning operation precisely adapted to the change state can be executed. For example, the number of flushing operation times is larger, the deteriorated ink is discharged the more frequently. Thus the ink quality change degree in the nozzle orifices 2 and the vicinities thereof is low. In contrast, the number of flushing operation times is smaller, the deteriorated ink is discharged less frequently. Thus the ink quality change degree in the nozzle orifices 2 and the vicinities thereof is high. Therefore, the level of the cleaning operation fitted to such a quality change degree is set, whereby good cleaning operation can be accomplished. Thus, as the cleaning operation fitted to the flushing operation history is performed, the cleaning operation corresponding to the real state of the deteriorated ink in the ink jet record apparatus is achieved.

Since the ink quality change degree changes depending on the duration of the nonoperating time, the cleaning operation precisely adapted to the change state can be executed. For example, the nonoperating time is shorter, the ink quality change development degree is shorter. Thus the ink quality change degree in the nozzle orifices 2 and the vicinities thereof is low. In contrast, the nonoperating time is longer, the ink quality change development degree is more severe. Thus the ink quality change degree in the nozzle orifices 2 and the vicinities thereof is high. Therefore, the level of the cleaning operation fitted to such a quality change degree is set, whereby good cleaning operation can be accomplished. Thus, as the cleaning operation fitted to the flushing operation history is performed, the cleaning operation corresponding to the real state of the deteriorated ink in the ink jet record apparatus is achieved.

Since the cleaning operation can be executed more fitted to the ink quality change degree, the level of the cleaning operation is optimized and recovery of the record head 36 can be well accomplished. That is, usually, most of deteriorated ink is removed roughly to the initial state as the cleaning operation is performed, and thus the operation condition of the last of the flushing operation executed in sequence in the state is fitted to the ink quality change degree at the time. Therefore, the cleaning operation in accordance with the operation condition of the last flushing operation is performed, whereby the level of the cleaning operation more fitted to the ink quality change degree is set and the good cleaning operation is executed.

Since the flushing operation condition is set based on the relation between the cumulative time for which the nozzle orifices 2 are left in a sealing state and the cumulative time for which ink jet has been executed, the flushing operation condition set under the relation between both the cumulative times is set as the operation condition precisely fitted to the ink quality change degree. Therefore, the cleaning operation in accordance with the operation condition is performed, whereby the cleaning operation becomes more fitted to the real state of the ink quality change degree and the optimized level of the cleaning operation is achieved accordingly.

Since the environmental conditions of the temperature, the humidity, etc., at the installation location of the ink jet record apparatus are taken into consideration to set the cleaning operation condition, the operation condition is set also fitted to the environmental conditions of the temperature and the humidity and the optimum operation condition fitted to all surrounding conditions can be set, making it possible to perform the cleaning operation most corresponding to the ink quality change state.

The cleaning operation condition is set so as to change the suction amount of ink from the nozzle orifices 2. Thus the ink suction amount is increased or decreased in accordance with the ink quality change degree, etc. Therefore, the ink suction amount optimized for removing the deteriorated ink in the nozzle orifices 2 and the vicinities thereof is secured and good cleaning operation can be accomplished.

Since the ink suction amount in the cleaning operation is made proportional to the quality change degree in the quality change area, the suction amount precisely adapted to the real state of ink quality change can be secured and it is made possible to perform the cleaning operation most corresponding to the ink quality change state. The quality change area is previously classified into a plurality of areas, whereby the optimized cleaning operation responsive to the quality change degree class can be executed.

Since the recovery operation is performed before start of a job with ink jet based on one operation command signal given to the record head 36 as an operation unit, the recovery operation of cleaning or flushing is always performed before start of a job, recovery in the nozzle orifices 2 and the vicinities thereof is reliably accomplished, and liquid can always be ejected in the best state.

In the embodiments, the case where the cleaning mode is set in correlation with the number of flushing times, the case where the cleaning mode is set in correlation with the number of flushing times and the last flushing mode, the case where the cleaning mode is set in correlation with the nonoperating time, and the case where the cleaning mode is set in correlation with the nonoperating time and the level of the last flushing mode have been described. However, the cleaning mode may be set in correlation with the number of flushing times and the nonoperating time or may be set in correlation with the number of flushing times, the nonoperating time, and the level of the last flushing mode.

In the embodiments, to set each mode FL1 to FL4, the environmental conditions of the temperature, the humidity, etc., at the installation location of the ink jet record apparatus can also be taken into consideration in addition to the factors of the viscosity increase speed, the consumption amount, etc., of a ink in accordance with a kind of the ink. For example, in a high-temperature environment wherein the moisture in ink easily evaporates, the mode FL4 is set wide so as to become an area put into high viscosity in comparatively short leaving time and comparatively short total printing time. Particularly, since the ink quality change degree is remarkable in the mode FL4 area served as high viscosity area, setting with the environmental conditions taken into consideration as described above is effective. However, area setting with the environmental conditions taken into consideration does not limit to apply to only FL4. The area setting can be applied to FL1 to FL3, and cleaning area.

To set the ink ejecting amount (the number of shot times) at the flushing operation time in each mode FL1 to FL4, the environmental conditions of the temperature, the humidity, etc., can also be taken into consideration. For example, the ink ejecting amount in the winter season or in a cold district is made larger than that in the summer season or in a warm district, whereby the ink ejecting amount in the flushing operation also fitted to the environmental conditions can be secured. In a high-temperature environment wherein the moisture in ink easily evaporates, the ink ejecting amount at the flushing operation time can be increased for more completely removing ink having the high viscosity. Particularly, since the ink quality change degree is remarkable in the mode FL4 (first-time mode) served as high viscosity area, setting with the environmental conditions taken into consideration as described above is effective; the environmental conditions can be taken into consideration not only for FL4, but also for FL1 to FL3, cleaning area setting.

In the embodiments, the number of flushing times before start of a print job or after termination of a print job is stored in the flushing history storage unit 44. The number of flushing times before start of a print job or intensive flushing after termination of a print job is thus counted, whereby the count operation can be performed in association with the print job start operation, so that the operation circuit, etc., for the count operation can be simplified. Since the number of times of only the flushing operation executed before start of a print job is counted, the count target is simplified and the count accuracy can be enhanced. Further, scheduled flushing executed at a midpoint of an operation job, the intensive flushing, a flushing after the cleaning operation, and the like are executed as the flushing operation subordinate to the print operation after start of a print job. Thus, the flushing operation history applied substantially to every flushing can be grasped precisely by counting the number of times of the flushing operation which has been performed before start of a print job is counted as the representative flushing of the various types of flushing mentioned above.

As the number of flushing times, the number of flushing times including flushing before start of a print job, scheduled flushing executed at a midpoint of an operation job, intensive flushing, flushing after the cleaning operation, and the like may be counted. A liquid ejecting job corresponds to a print job in the ink jet record apparatus.

The embodiments show the record head used with the ink jet record apparatus. However, this invention is not limited to the ink-jet recording head of the ink jet record apparatus. The liquid ejecting head according to the invention can eject not only ink for the ink jet record apparatus, but also glue, manicure, electrically conductive liquid (liquid metal), etc.

What is claimed is:

1. A liquid ejecting apparatus, comprising:

a liquid ejecting head, having nozzle orifices for ejecting liquid therefrom; and a controller, which performs a recovery operation, wherein the recovery operation is performed by using at least a flushing operation in which the liquid drops are ejected from the nozzle orifices and a cleaning operation in which a negative pressure is applied to the nozzle orifices;

wherein an operation condition of the flushing operation is set in accordance with leaving time from the preceding cleaning operation and total printing time after the preceding cleaning operation;

wherein an operation condition of the cleaning operation is set in accordance with the number of times the flushing operation is executed after the preceding cleaning operations;

wherein a first negative pressure is applied to the nozzle orifices in the cleaning operation flushing operation is executed a first number of times; and wherein a second negative pressure which is higher than the first negative pressure is applied to the nozzle orifices in the cleaning operation when the flushing operation is executed a second number of times which is greater than the first number of times.

2. The liquid ejecting apparatus as set forth in claim 1, wherein the flushing operation the number of times of which is counted is a flushing operation performed before start of a liquid ejecting job or after termination of a liquid ejecting job.

3. The liquid ejecting apparatus as set forth in claim 1, wherein the operation condition of the cleaning operation is set in accordance with the operation condition of the last flushing operation in at least one flushing operation performed after the preceding cleaning operation.

4. The liquid ejecting apparatus as set forth in claim 3, wherein the last flushing operation is a flushing operation performed before start of a liquid ejecting job or after termination of a liquid ejecting job.

5. The liquid ejecting apparatus as set forth in claim 3, wherein the operation condition of the flushing operation is set in accordance with a relation between a first cumulative time for which the nozzle orifices are left in a sealed state and a second cumulative time for which a liquid ejection is executed.

6. The liquid ejecting apparatus as set forth in claim 3, wherein the operation condition of the last flushing operation is set so as to change the amount of the liquid ejected from the nozzle orifices.

7. A liquid ejecting apparatus, comprising:

a liquid ejecting head, having nozzle orifices for ejecting liquid therefrom; and a controller, which performs a recovery operation, wherein the recovery operation is performed by using at least a flushing operation in which the liquid drops are ejected from the nozzle orifices and a cleaning operation in which a negative pressure is applied to the nozzle orifices;

wherein an operation condition of the flushing operation is set in accordance with leaving time from the preceding cleaning operation and total printing time after the preceding cleaning operation;

wherein a first negative pressure is applied to the nozzle orifices in the cleaning operation when a first amount of the liquid drops are ejected from the nozzle orifices in the last flushing operation in at least one flushing operation performed after the preceding cleaning operation; and wherein a second negative pressure which is higher than the first negative pressure is applied to the nozzle orifices in the cleaning operation when a second amount of the liquid drops which is greater than the first amount of the liquid drops are ejected from the nozzle orifices in the last flushing operation in at least one flushing operation performed after the preceding cleaning operation.

* * * * *